US009074396B2

(12) United States Patent
Packer

(10) Patent No.: US 9,074,396 B2
(45) Date of Patent: Jul. 7, 2015

(54) FLEXIBLE DOOR STOP

(71) Applicant: Michell Soares Packer, Wichita Falls, TX (US)

(72) Inventor: Michell Soares Packer, Wichita Falls, TX (US)

( * ) Notice: Subject to any disclaimer, the term of this patent is extended or adjusted under 35 U.S.C. 154(b) by 0 days.

(21) Appl. No.: 13/941,743

(22) Filed: Jul. 15, 2013

(65) Prior Publication Data

US 2014/0084606 A1 Mar. 27, 2014

Related U.S. Application Data

(63) Continuation-in-part of application No. 13/921,354, filed on Jun. 19, 2013.

(60) Provisional application No. 61/708,012, filed on Sep. 30, 2012, provisional application No. 61/705,656, filed on Sep. 26, 2012.

(51) Int. Cl.

| | |
|---|---|
| ***E05C 17/54*** | (2006.01) |
| ***E05C 19/18*** | (2006.01) |
| *E05C 17/00* | (2006.01) |

(52) U.S. Cl.

CPC ..... *E05C 19/182* (2013.01); *E05C 17/54* (2013.01)

(58) Field of Classification Search

USPC ..... 292/342, 343, DIG. 15

See application file for complete search history.

(56) References Cited

U.S. PATENT DOCUMENTS

| | | | | | |
|---|---|---|---|---|---|
| 4,968,281 | A | * | 11/1990 | Smith et al. | 446/369 |
| 5,288,257 | A | | 2/1994 | Zacherl | |
| 5,291,631 | A | * | 3/1994 | Schjoneman | 16/86 R |
| 5,501,494 | A | | 3/1996 | Willetts | |
| 5,542,723 | A | * | 8/1996 | Scharf | 292/289 |
| 5,794,871 | A | | 8/1998 | Willetts | |
| 5,810,404 | A | * | 9/1998 | Horne et al. | 292/288 |
| 5,873,146 | A | | 2/1999 | Mungo et al. | |
| D591,147 | S | | 4/2009 | Lorenzati | |
| 7,766,400 | B2 | | 8/2010 | Predebon | |
| 2006/0163888 | A1 | * | 7/2006 | Bowser | 292/343 |
| 2007/0126248 | A1 | * | 6/2007 | Mintz | 292/342 |
| 2009/0255085 | A1 | | 10/2009 | Lorenzati | |

FOREIGN PATENT DOCUMENTS

| | | | | | |
|---|---|---|---|---|---|
| GB | 2224949 | | * | 5/1990 | |
| JP | 02008480 | A | * | 1/1990 | E05C 17/54 |

* cited by examiner

*Primary Examiner* — Carlos Lugo

(74) *Attorney, Agent, or Firm* — Braxton, Hilton & Perrone, PLLC; Zachary W. Hilton

(57) ABSTRACT

A door stop for mounting on a door, the door stop having one or more body segments. A first body segment of the door stop is connected to a second body segment of the door stop via an elastic connecting member. The first body segment positioned to face a door frame, is configured such that it may be extended downward in relation to the rest of the door stop, thereby allowing the door to close. A handle attached to the first body segment provides users with a structure to extend said first body segment downward. The second body segment, configured to be mounted on a door such that such segment faces a wall, serves to protect the door and wall in instances when the door may be opened too widely. The door stop may be removably or fixedly mounted to a door.

10 Claims, 10 Drawing Sheets

FLEXIBLE DOOR STOP

CROSS REFERENCE TO RELATED APPLICATIONS

This application is a continuation-in-part of U.S. Non-Provisional patent application Ser. No. 13/921,354, filed on Jun. 19, 2013, which further claims the benefit of U.S. Provisional Patent Application No. 61/708,012, filed Sep. 30, 2012, and further claims the benefit of U.S. Provisional Patent Application No. 61/705,656, filed on Sep. 26, 2012, which are incorporated by reference herein.

PARTIAL WAIVER OF COPYRIGHT

All of the material in this patent application is subject to copyright protection under the copyright laws of the United States and of other countries. As of the first effective filing date of the present application, this material is protected as unpublished material.

However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

BACKGROUND OF THE INVENTION

1. Technical Field of the Invention

The invention relates generally to a door stop apparatus and in particular, to a door stop having one or more segments wherein at least one of said segments is adjustable such that in one mode the door stop may be utilized to prevent the closure of a door, and in a second mode the door stop may be configured by a user to allow said door to fully close without obstruction.

2. Description of the Related Art

The use of door stops in both residences and businesses to prevent damage to doors and adjacent walls that may result from collisions between such structures is well-known. Most typically, a door stop is mounted to a wall adjacent to a door and is optimally placed on the wall at a location such that a door knob or the door itself will, if the door is opened too widely, collide with the door stop and not the wall. The door stop, often constructed of a soft material such as rubber or plastic, or alternatively, a spring having a soft rubber or plastic tip mounted to one end, will ideally absorb the impact of the collision between the door and the wall, thus preventing damage to both structures.

Door stops are also commonly mounted upon doors and operate in much the same manner as wall-mounted door stops as described above. Namely, a door-mounted door stop, constructed at least partially of a soft material, is mounted on a wall-facing surface of a door such that when the door is opened too widely, the door stop absorbs the impact of the collision between the door and the wall (or other object). Such door-mounted door stops may be mounted on a door knob or any other surface of a door.

While the most common function served by door stops is to prevent damage to doors, walls and other inanimate objects, door stops also may serve to prevent or reduce injury to persons resulting from the movement of a door. For example, it is widely known that very young children are fond of opening and closing doors, often without any regard for their own well-being, the well-being of other persons or pets, or consideration for household furnishings. In fact, children will often slam a door with great force such that if their fingers or other appendages (or those of others) are caught between the door and the door frame, injury will result. Other harm that may potentially result from children closing doors may occur when such action causes a child to be isolated from his or her parents because of an inadvertently locked door, or because by closure of the door, the child's parent(s) or other caretaker (s) are less likely to be able to hear the child. In view of these potential harms, a door stop that can prevent a door from closing meets a great need of parents and caretakers. A door stop structure found in the prior art that at least partially addresses the problem described above is found in door stops having "U" shaped bodies that may be hung over a door, or around one edge of a door, such that said door stop prevents the door from closing.

The use of elongated door stop structures that are configured to be hung over the top of a door lengthwise, such that the thickness of the door stop lying on the top surface of the door acts as an obstruction which prevents the door from being closed, is known in the art. While such door stop structures function to obstruct the closure of a door to which it is mounted, one disadvantage of such a structure is that it cannot be easily removed or repositioned to allow for the door to be closed. More specifically, the shape of such a structure, having a thick body portion that rests on the top of the door, requires that the entire door stop be removed in order to close the door. In the case of some embodiments of such door stops, the "appendages" of the door stop structure are fastened to the door, thus making the removal of the door stop even more time-consuming and inefficient.

Other door stops found in the prior art suffer from the same or similar disadvantages. Namely, the entire door stop, or a portion of the door stop, must be removed from the door stop in order to close the door to which it was mounted. For example, some embodiments of such prior art door stops teach the use of an "interference member," shaped like a wedge, dome, or some other interfering shape, which may be removably disposed in a compartment, which is in turn disposed on the elongated strip. The "interference member" disposed within the compartment is configured to reside over the top of a door so as to prevent the door (to which the door stop is mounted) from closing.

While such a door stop functions to prevent the closure of a door to which it is attached, it suffers from a similar disadvantage as the other prior art designs which have been previously discussed above. More specifically, the "interference member" of the door stop must be removed, or the entire door stop removed, in order to permit the door to be closed. Such a configuration is inefficient because it increases the difficulty and time required to close a door as it is necessary to remove all or a portion of the door stop from the door. As the "interference member" of such embodiments is most typically configured to be positioned at the top of a door, the member is more difficult to access if removal of said member is sought.

In summary, there are many drawbacks and other problems found in door stop structures known in the art. The present invention, in various embodiments, seeks to remedy these and other problems found in the prior art.

BRIEF DESCRIPTION OF THE SEVERAL VIEWS OF THE DRAWINGS

A more complete understanding of the invention may be had by reference to the following detailed description of various embodiments when taken in conjunction with the accompanying drawings, wherein.

Figure 1:
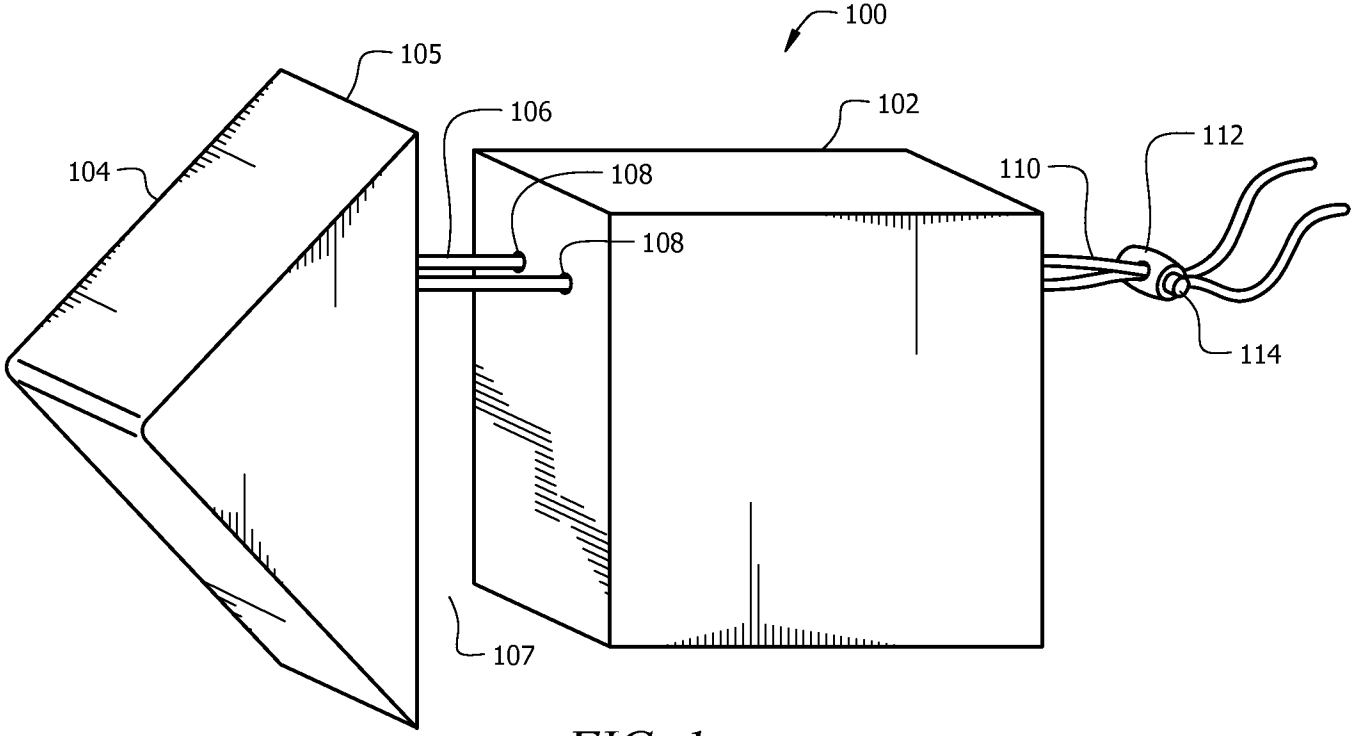
FIG. 1 shows a perspective view of a first embodiment of the door stop invention having two body segments connected by first and second elastic cords.

Where used in the various figures of the drawings, the same reference numerals designate the same or similar parts. Furthermore, when the terms "anterior," "posterior," "front," "rear," "aft," "forward," "first," "second," "upper," "lower," "height," "top," "bottom," "outer," "inner," "width," "length," "end," "side," "horizontal," "vertical," and similar terms are used herein, it should be understood that these terms have reference only to the structure shown in the drawing and are utilized only to facilitate describing the invention.

All figures are drawn for ease of explanation of the basic teachings of the invention only; the extensions of the figures with respect to number, position, relationship, and dimensions of the parts to form the preferred embodiment will either be explained or will be within the skill of persons of ordinary skill in the art after the following teachings of the present invention have been read and understood. Further, the exact dimensions and dimensional proportions to conform to specific width, length, and similar requirements will likewise be within the skill of the art after the following teachings of the invention have been read and understood.

DETAILED DESCRIPTION OF THE DRAWINGS

Several embodiments of Applicant's invention will now be described with reference to the drawings. In most cases, the items being discussed below correlate to a figure and a reference numeral(s) appearing on the attached drawings.

Referring to FIG. 1, a perspective view of a first embodiment of the door stop invention having two body segments connected by adjustable elastic cords which serve as a first connecting member. The door stop (100) embodiment shown in FIG. 1 comprises a posterior body segment (102) and an anterior body segment (104) connected by elastic cords (106). One or more holes (108) are formed within the body segments, through which the cords (106) may be inserted. The elastic cord (106) is affixed or anchored to the rear end of the anterior body segment (104). However, the cords (106) are not anchored to the posterior body segment (102) but rather the cords (106) are configured to slide freely through the holes in the forward end of the posterior body segment such that the distance or "gap" (107) between the anterior body segment and the posterior body segment may be shortened or lengthened. The distance or gap (107) between the anterior body segment (104) and posterior body segment (102) is preferably sized by a user based on the width of the door (not shown) to which the door stop will be mounted. A fastener (112) such as a spring-loaded button clamp may be positioned on the cord (106) to prevent the posterior body segment from sliding beyond a predetermined point on said cord. The clamp (112) includes a spring-loaded button (112) that allows a user to adjust the distance (the "gap" (107)) between the anterior body segment (104) and the posterior body segment (102). Although a spring-loaded clamp is used in the preferred embodiments, other alternate embodiments may utilize other mechanisms for at least temporarily securing the body segments of the door stop in place and enabling a user to adjust the size of the gap between the body segments. Even further alternate embodiments of the door stop, such as, for example, the alternate embodiment of the door stop shown at FIGS. 8, 9, 10A, 10B and 10C, may not utilize any mechanism other than an elastic connecting member to regulate the size of the gap between the body segments. Even further other alternate embodiments may utilize a substantially rigid connecting member, such as that which is utilized by the alternate embodiment of the door stop shown at FIG. 7 and FIG. 8.

With reference to the embodiment shown at FIG. 1, the posterior body segment (102) is preferably the body segment of the door stop that is most distal to the door frame when said door stop is intended to act as an obstruction to keep the door from fully closing. When the door to which the door stop is mounted is fully opened, the posterior body segment (102) functions as a blocking member or cushion structure, absorbing the impact that would otherwise result between the door and a wall or other object in the path of the swinging door that is being opened. The posterior body segment is thus preferably sized to have a length (distance from large plane of door to which it is mounted) greater than any other hard protrusion of the door, or otherwise mounted or fastened to the door, such as a door knob. Thus, the posterior body segment will ideally absorb the impact of the door upon a wall first, thereby preventing any other protrusion on the door (such as a door knob) from striking the wall and causing unwanted damage. While the posterior body segment shown in FIG. 1 is rectangular in shape, it is contemplated that alternate embodiments of the door stop invention may have other various geometric shapes, both regular and irregular (for example, as shown in the alternate embodiments of the door stop appearing at FIGS. 8, 9, 10A, 10B and 10C).

The anterior body segment (104) is positioned more proximally to the door frame as compared to the posterior body segment (102). The anterior body segment (104) serves to block the closure of the door (not shown) to which the door stop is attached. The inclined top surface (105) of the anterior body segment (104), which has a height greater than that of the posterior body segment, such that said anterior body segment is configured to have a portion that extends beyond the top surface of the door to which the door stop is mounted, acts as a wedge, sliding underneath a door frame. Thus, in this manner, the anterior body segment (104) works to slowly bring the movement of the door to a halt when in contact with the door frame, and prevents the door from fully closing.

While the anterior body segment shown in FIG. 1 is generally triangular in shape, it is contemplated that alternate embodiments of the door stop may have other various geometric shapes, both regular and irregular (for example, as shown in the alternate embodiments of the door stop appearing at FIGS. 8, 9, 10A, 10B and 10C). The anterior body segment is preferably shaped such that at least some portion of said body segment extends beyond the top surface of the door (upon which door stop is mounted) when the door stop is used to prevent full closure of said door.

While the embodiments shown herein comprise two main body segments, it is contemplated that other alternate embodiments of the door stop invention may comprise more or fewer body segments. For example, an alternative embodiment of the door stop invention may comprise a single flexible anterior body segment removably mountable on a door via a connector or some other mounting device or fastener. Moreover, while the embodiments shown herein are removably mountable on a door, alternate embodiments of the door stop may be removably or non-removably fastened, attached, or otherwise mounted to the door by any means such as, for example, screws, nails, adhesives, magnets, welding, velcro, etc.

The elastic cords (106) described herein for joining the body segments (102, 104) of the door stop are each generally constructed of one or more elongate strands of natural or synthetic rubber, said strand(s) being bundled together or covered with a braided fabric sheath which may be composed of natural or synthetic (or blends thereof) fibers such as cotton, polyester, nylon, polypropylene, polyamides, or other polymers. However, it is contemplated that other materials may be used, having generally elastic or rigid properties, to connect the body segments of alternate embodiments of the door stop invention. Likewise, other types of elastic or rigid materials may be used to mount or fasten alternate embodiments of the door stop invention, having a single body segment, to a door. In such a single body segment alternate embodiment, it is contemplated that the mount, fastener, or other attachment device is secured (removably or non-removably) to both said body segment and to the top of a door (or side of a door).

Figure 2:
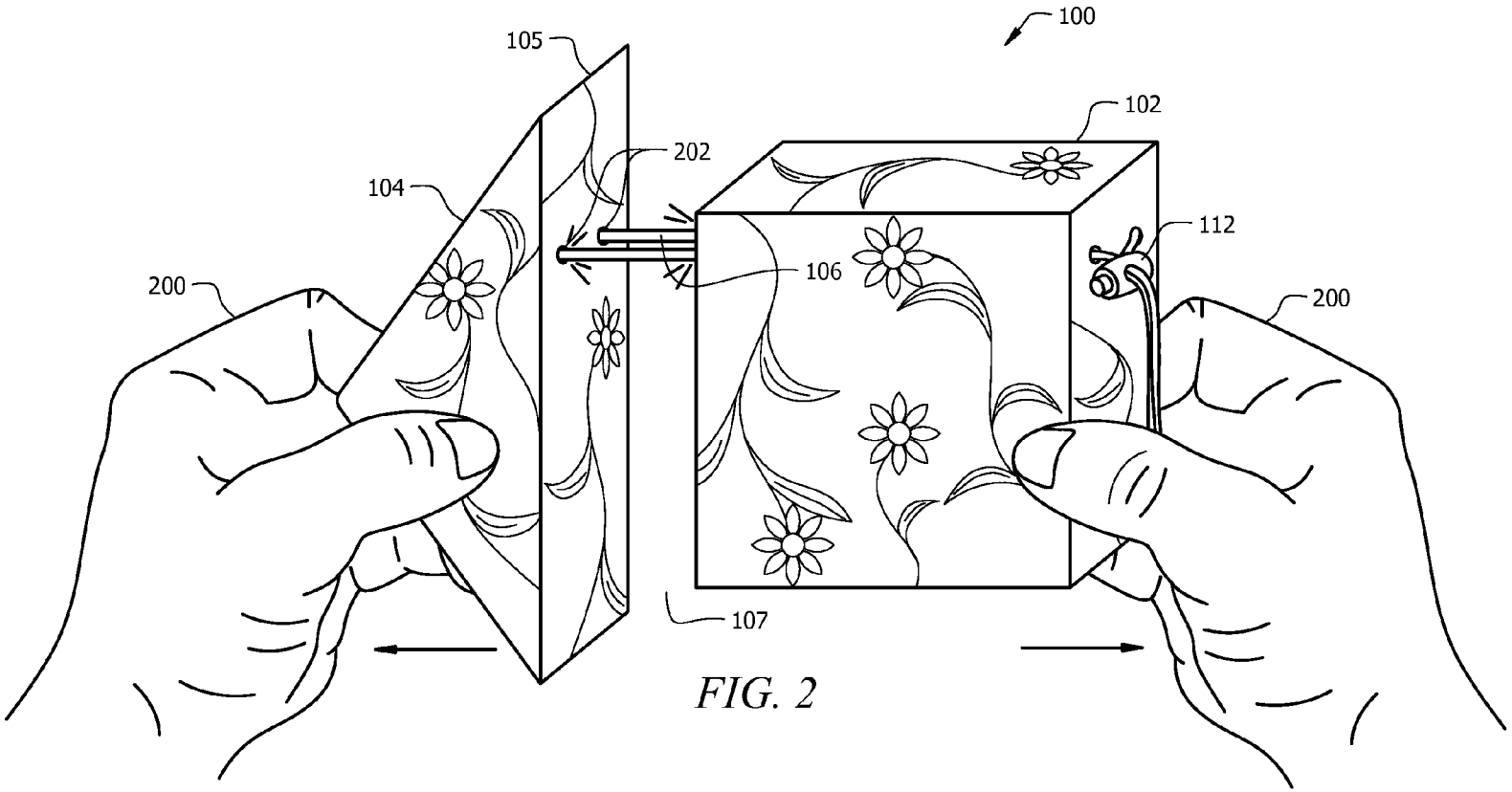
FIG. 2 shows a perspective view of the embodiment of the door stop invention shown in FIG. 1, said embodiment capable of being stretched due to the elasticity of the first and second cords connecting the two body segments.

Referring now to FIG. 2, a perspective view of the embodiment of the door stop invention shown in FIG. 1, the body segments of said embodiment having a decorative fabric covering attached to said segments. Holes (202) formed into the rear surface of the anterior body segment (104) receive the ends of the elastic cords (106). The anterior ends of the cords are anchored within the anterior body segment (104) via a fastener or adhesive. The cords, because of their elastic nature and because the spring-loaded clamp (112) may be used to act as a stop with respect to the posterior body segment (102), allows a user (200) the ability to adjust the distance or "gap" (107) between the anterior body segment (104) and posterior body segment (102). A user will preferably adjust the size of the gap (107) between the two segments such that the door stop may be snugly mounted to the top surface of a door (not shown).

Figure 3:
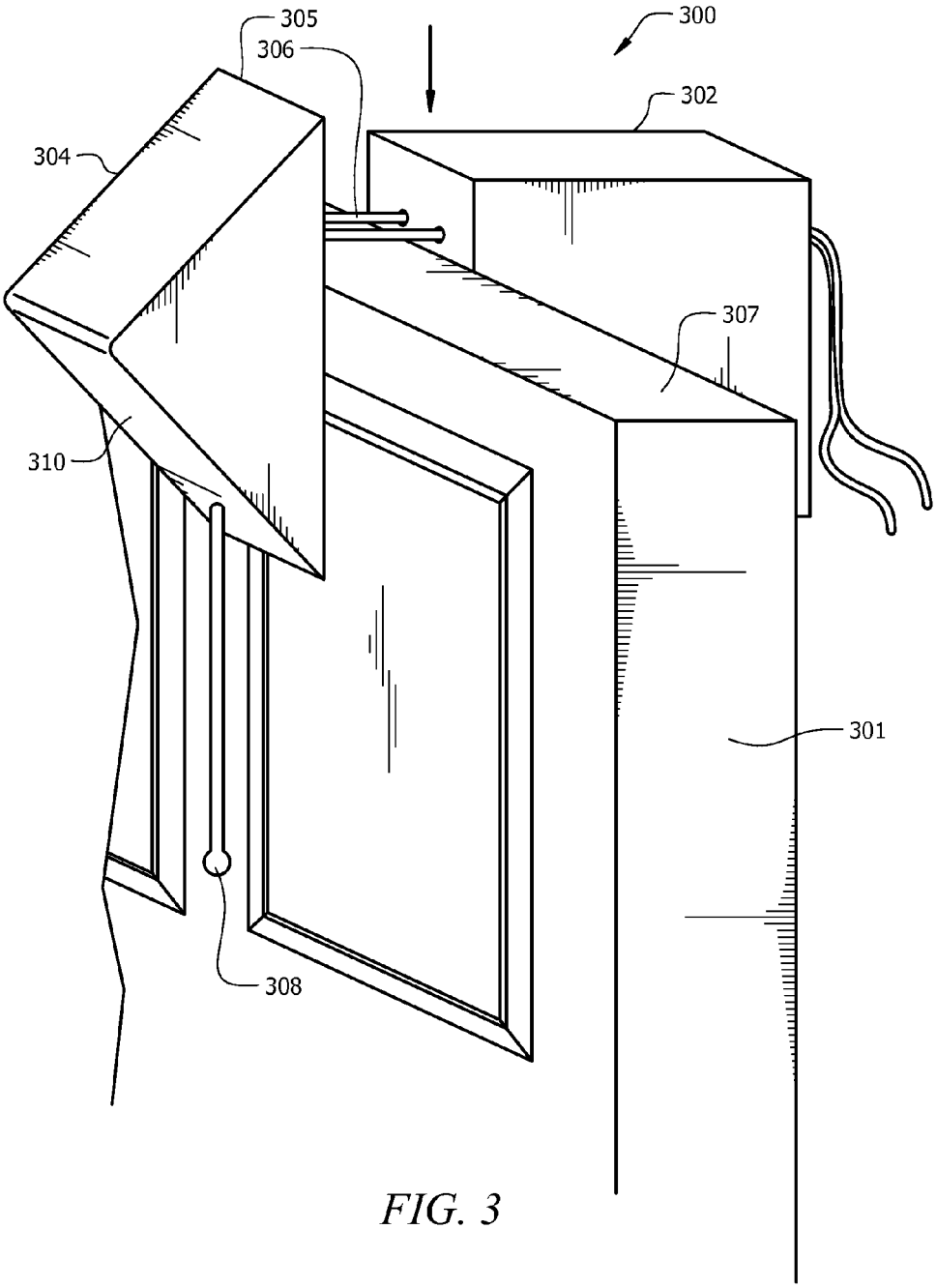
FIG. 3 shows a perspective view of a second alternate embodiment of the door stop invention mounted on the top of a door, said embodiment having a third cord mounted to the anterior body segment.

Referring now to FIG. 3, a perspective view of a second alternate embodiment of the door stop invention mounted on the top of a door (301), said embodiment (300) comprising a posterior body segment (302) and an anterior body segment (304) connected by two elastic cords (306). As discussed above in connection with the embodiments of the door stop shown at FIG. 1 and FIG. 2, a user may adjust the width of the gap between the two body segments such that the door stop fits snugly over the top surface (307) of a door (301). A clamp (of the type shown at reference numeral 112 at FIG. 1) or other fastener may be used to restrict the movement of the posterior body segment (302). Approximately the top two-thirds of the anterior body segment (304) of the door stop (300) shown at FIG. 3 extends beyond the top surface of the door (301). When the door stop is used in a first mode of operation, the anterior body segment prevents the full closure of the door (301) by wedging itself under the bottom of the adjacent door frame (not shown). Thus, in this manner, the anterior body segment (304) acts to prevent the door (301) from fully closing, and also helps to absorb the impact of any collision that would otherwise occur between the door and an adjacent door frame.

A third cord (308), acting as a handle, is attached to the forward end (310) of the anterior body segment (304). As discussed in further detail below, the third cord (308) provides a user of the door stop with a structure by which to pull and thereby extend the anterior body segment (304) in a downward direction (towards floor), allowing the door (301) to be closed. While a third cord (308) is used in the embodiment of the door stop shown in FIG. 3, other alternate embodiments of the door stop may include other types of handles constructed with other types of materials and having different shapes (for example, see handle (808) appearing at FIG. 8), which a user may utilize to move the anterior portion such that the door upon which the door stop is mounted may be closed. By way of another alternate example of a handle that is contemplated, the anterior body segment itself may be shaped in such a manner that provides a handle or handhold on which a user may move said segment in a downward direction, allowing the door to close. While not preferred, it is also contemplated that an alternate embodiment of the door stop may utilize a body segment that may be extended in an upward or sideways direction such that the door upon which the door stop is mounted may be fully closed.

Figure 4:
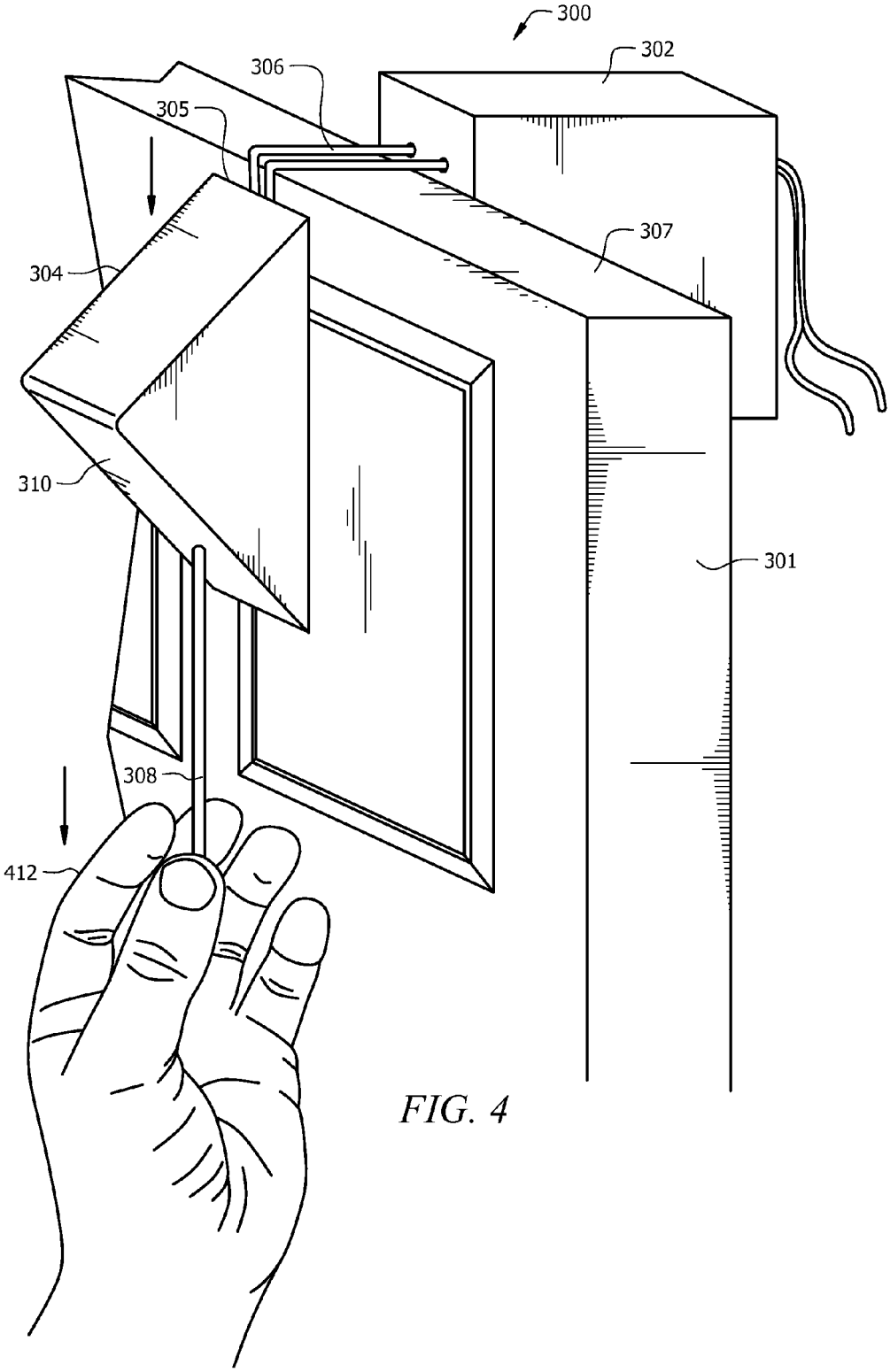
FIG. 4 shows a perspective view of the embodiment of the door stop invention shown in FIG. 3, said third cord mounted to the anterior body segment allows said segment to be pulled downward, allowing the closure of the door.

Referring now to FIG. 4, a perspective view of the embodiment (300) of the door stop invention shown in FIG. 3, the cord (308) mounted to the anterior body segment (304) allows said segment to be extended in a downward direction, allowing the door (301) to fully close. When a user (412) pulls downward on the cord (308), the anterior body segment (304) extends downward, stretching the elastic cords (306) which connect said anterior body segment (304) to the posterior body segment (302). When the anterior body segment (304) is pulled downward such that no portion of said segment (304) protrudes beyond the top surface of the door (307) (when the top portion (305) of the anterior body segment does not protrude above the top of the door), the door may be fully closed as the anterior body segment will no longer collide with the adjacent door frame (not shown).

While the posterior body segment of the embodiment shown in FIG. 3 and FIG. 4 has a top surface that extends beyond the top surface of the door (307), it should be noted that in other alternate embodiments of the door stop invention, the posterior body segment may be sized and shaped such that no portion of said segment (302) protrudes beyond the top surface of the door (307). In such alternate embodiments, the door may be closed by either removing the door stop entirely or by rotating the door stop one hundred, eighty degrees and mounted on the door such that the posterior body segment is more proximal to the door frame than the anterior body segment, thus allowing the door to be closed.

While the embodiments of the door stop shown in the figures herein are mounted on the top surface of a door, it is contemplated that other alternate embodiments may be mounted on a side surface of a door in the same manner with which the door stop is mounted to a top surface of a door. Namely, the user may adjust the size of the gap (107) to snugly fit onto such side surface of a door. If the door stop is mounted to the side of a door, a user may simply use the handle (308) (or the anterior body segment itself) to move the anterior body segment in a direction towards the door hinges to allow the door to be fully closed.

In a further alternate embodiment of the door stop, said door stop may be alternatively configured for mounting on the side of a door. Holes may be formed in the anterior body segment such that the connecting cord may run through the entire anterior body segment, through which one or more cords may be secured within. A first loop of cord may be formed on the anterior face of the anterior body segment by tying or otherwise connecting two end of the cords. A second loop of cord may be formed by the posterior cords between the clamp and the posterior body segment (as shown at FIG. 1 at 110). The door stop may be mounted on the side of a door by placing the first loop of cord around the anterior facing door knob and the second loop of cord around the posterior facing door knob. The portion of the cord located in the gap should preferably wrap over the strike plate and latch mechanism of the door knob. The clamp may be adjusted as needed to secure the door stop snugly into place on the side of the door. When a need arises to close the door while the door stop is mounted to the side of the door as discussed herein, it can be accomplished without the complete removal of the door stop. More specifically, a user may remove one of either the first loop of cord or second loop of cord, thus permitting the door knob to hang under the door knob such that the door may be closed in a normal fashion.

Figure 5A:
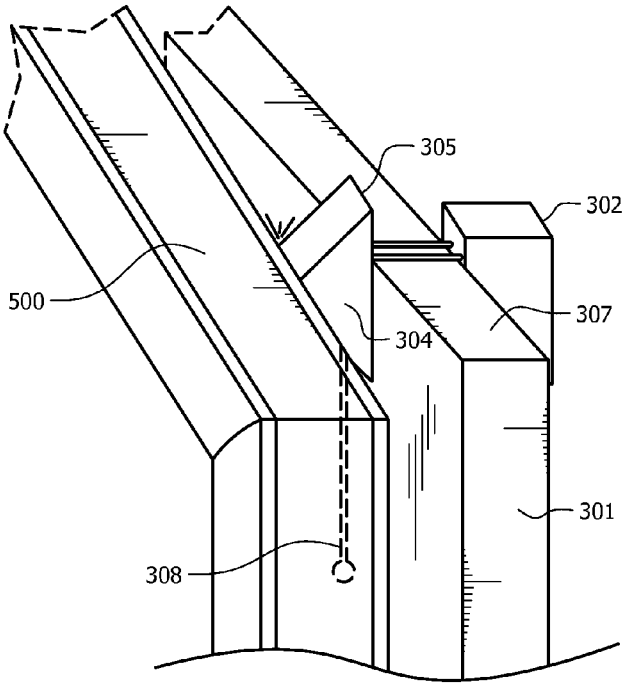
FIG. 5A shows a perspective view of the embodiment of the door stop invention shown in FIG. 4, mounted on a top surface of a door, the anterior body segment of said door stop colliding with a door frame, thereby preventing closure of the door.
Figure 5B:
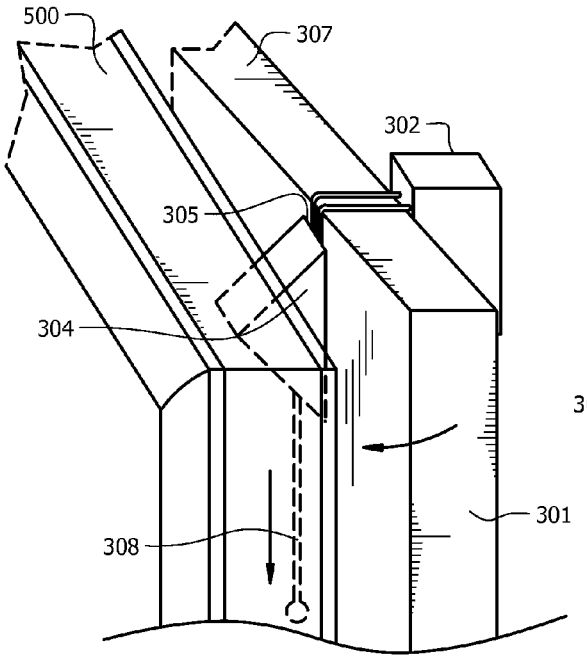
FIG. 5B shows a perspective view of the embodiment of the door stop invention shown in FIG. 5A, mounted on a top surface of a door, the anterior body segment of said door stop extending downward such that said anterior body segment no longer acts as an obstruction (with respect to door frame) that would prevent full closure of the door.
Figure 5C:
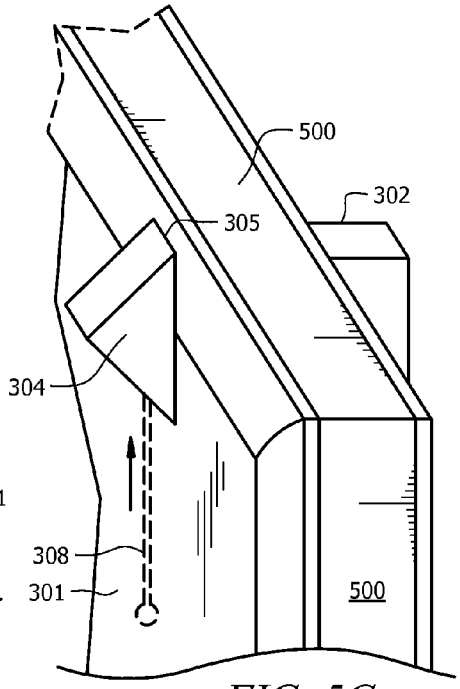
FIG. 5C shows a perspective view of the embodiment of the door stop invention shown in FIG. 5A and FIG. 5B, mounted on a top surface of a door that is fully closed, the anterior body segment of said door stop returning to a more upward resting position.

Referring now to FIG. 5A, FIG. 5B and FIG. 5C, perspective views of the alternate embodiment of the door stop shown at FIG. 3 and FIG. 4, said alternate embodiment mounted upon the top surface of a door (307). In a first mode of operation, the anterior body segment (304) is in a raised position such that the top portion (305) of said anterior body segment (304) extends above the top of the door (307). In the first mode of operation, shown at FIG. 5A, the anterior body segment (304) of the door stop prevents the full closure of the door as the top portion (305) of said body segment (304) collides with the underside of the adjacent door frame (500) when an attempt is made to fully close the door. Thus, the door stop in this first mode prevents the door from fully closing.

In a second mode of operation, shown at FIG. 5B, a user (not shown) may grasp the elongated handle structure (308), pull downward, thereby causing the anterior body segment to extend downward, thereby removing the obstruction (anterior body segment) that had previously prevented closure of the door. Referring to FIG. 5C, following closure of the door (301), the anterior body segment (304) returns to its previous upright position such that opening the door would require extending the anterior body segment downward once again.

It is contemplated that in alternate embodiments, a fastener such as a hook (configured to mate with a corresponding eyelet mounted on the door), or an adhesive suction cup for mounting to surface of the door, could be connected to the handle (308) or anterior body segment such that the anterior body segment could be at least temporarily secured in the downward position so that the door could freely open and close without interference of the door stop. In other alternate embodiments of the door stop, a velcro type strip may be attached to a portion of the anterior body segment (or handle) such that it could be secured to a corresponding velcro type strip mounted to the door. In this manner, the anterior body segment could be secured at least temporarily in a static position.

Figure 6:
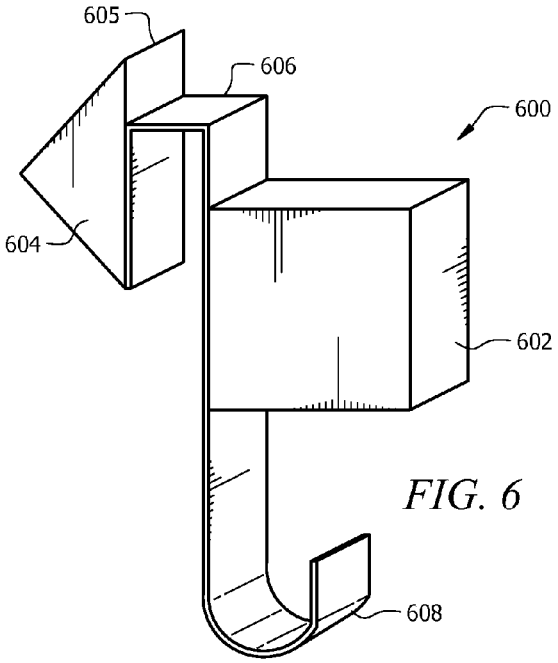
FIG. 6 shows a perspective view of a third alternate embodiment of the door stop invention having one anterior body segment that prevents the close of the door to which it is mounted, and a second posterior body segment that is configured to absorb the impact of collisions between the door and any adjacent wall or other object.
Figure 7:
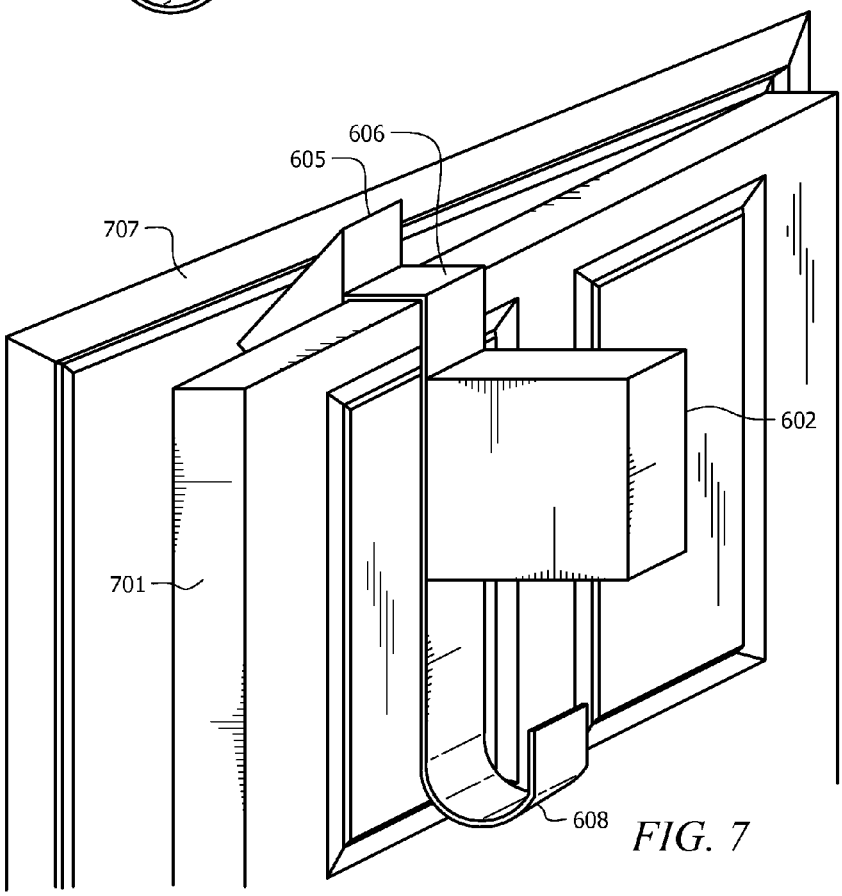
FIG. 7 shows a perspective view of the embodiment of the door stop invention shown in FIG. 6 mounted upon a top surface of a door.

Referring now to FIG. 6 and FIG. 7, perspective views of a further alternate embodiment of the door stop invention, the door stop has a connecting member (606) constructed of a rigid material. The embodiment (600) of the door stop invention shown includes a posterior body segment (602) and an anterior body segment (604), said segments being joined by a rigid connecting member (606) shaped to be placed on the top surface of a door (507). The top portion (605) of the anterior body segment (604) acts as a wedge with an adjacent door frame (707), thus preventing closure of the door (701). The posterior body segment (602), constructed at least partially of a soft material such as rubber or plastic, acts a stop to prevent damage to the door or wall when the door is opened too widely. The rigid connecting member (606) includes one end shaped in a hook form (608), providing a structure that may be used to hang clothing items, or by a user to more easily grasp the door stop in order to mount or remove said door stop.

Figure 8:
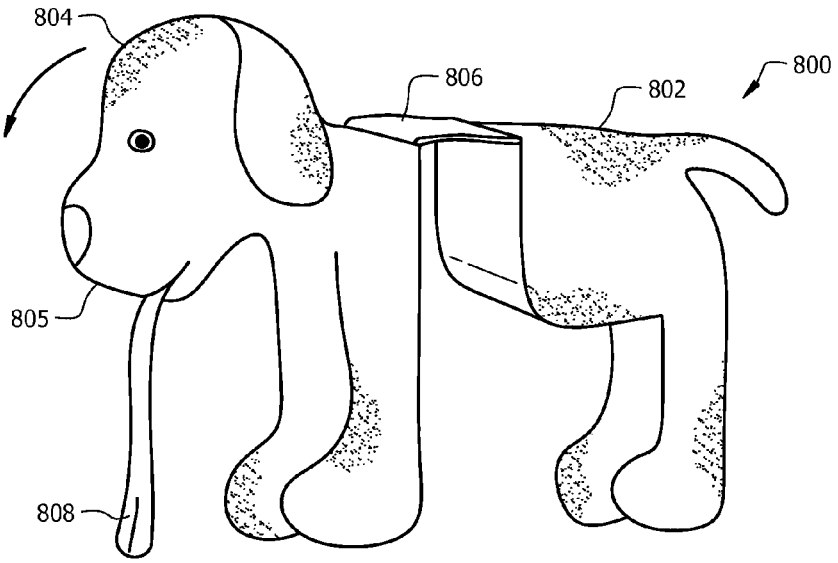
FIG. 8 shows a perspective view of a fourth alternate embodiment of the door stop invention having a decorative animal shape, the two body segments of the door stop being joined by a flexible strip of fabric material.
Figure 9:
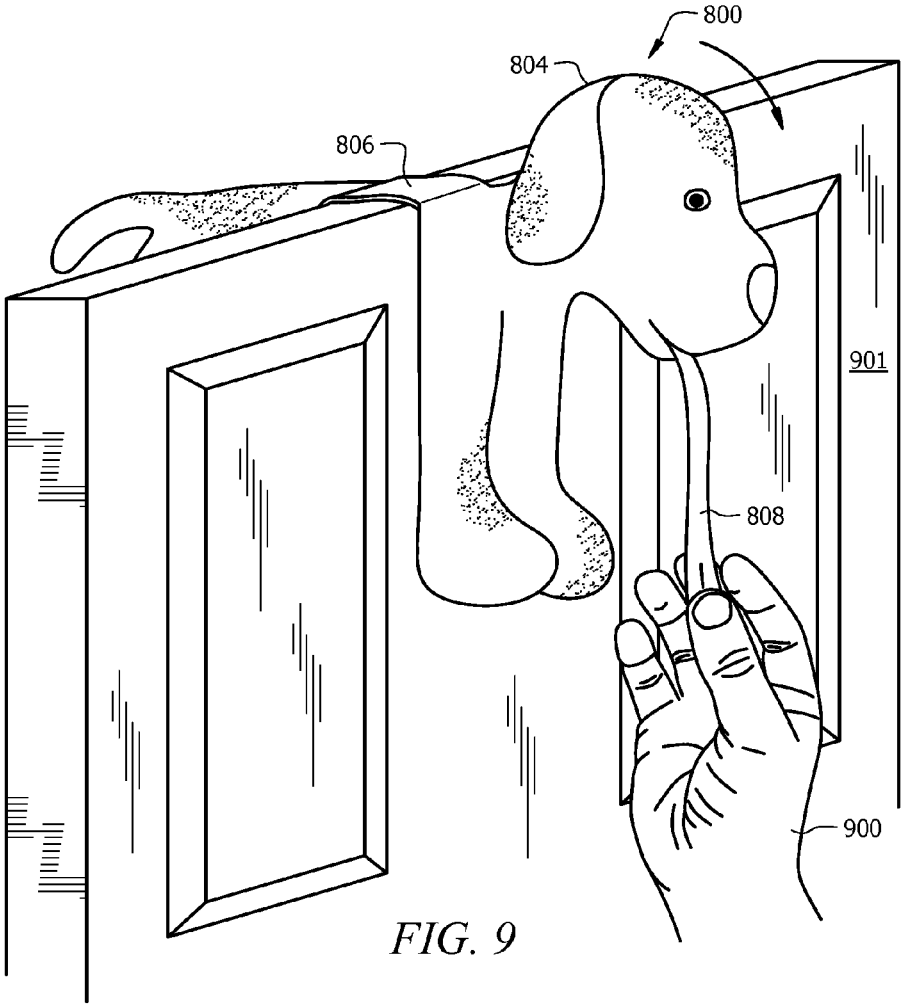
FIG. 9 shows a perspective view of the embodiment of the door stop invention shown in FIG. 8, said door stop having an elongated member attached to a flexible anterior body segment, allowing said flexible anterior body segment to be rotated downward such the door may be closed.

Referring now to FIG. 8 and FIG. 9, showing another alternate embodiment of the door stop invention having a decorative animal shape, the door stop (800) comprises a posterior body segment (802) connected to an anterior body segment (804) by means of a flexible connecting member (806). The connecting member is attached to a rear end of the anterior body segment (804) and a forward end of the posterior body segment (802). The door stop (800) is configured for mounting onto the top of a door (901) such that the connecting member (806) spans across the top of said door (901). An elongated handle structure (808) attached to the forward end (805) of the anterior body segment (804), said elongated structure (808) in this embodiment shown at FIG. 7 and FIG. 8 being formed to resemble a dog's tongue, provides a means by which a user may move the anterior body segment in a downward rotating extension, thereby allowing the door to close.

Referring now to FIG. 9, said alternate embodiment of the door stop (800) is mounted upon the top surface of a door (901). In a first mode of operation, shown in FIG. 9, the anterior body segment (804) is in a raised position such that the top portion of said body segment (804) extends above the top of the door (901). In this first mode of operation, described more fully below with reference to FIGS. 10A, 10B and 10C, the anterior body segment (804) prevents the full closure of the door as said segment (804) collides with the underside of the adjacent door frame (not shown). In a second mode of operation, a user (900) may grasp the elongated handle structure (808), pull in a downward direction, thereby causing the anterior body segment to extend or flex downward about the neck-like portion of the door stop, thereby allowing the door to close. It should be noted that for all purposes herein, the term "extend" shall be construed to encompass its ordinary meaning, as well as broader meanings associated with other terms related to movement such as "flex," "pivot," "bend," "rotate." For example, with reference to the embodiment of the door stop shown in FIG. 8 and FIG. 9, the anterior body segment is capable of pivoting or flexing downward and upwards, although the term "extend" is typically used to describe such motion herein.

In the alternate embodiment shown at FIG. 8 and FIG. 9, at least a portion of the anterior body segment, in this case the neck-like portion of such body segment, may be constructed of materials such as fabric stuffed with cotton, to give the head-like portion the ability to extend or flex upwards and downwards with respect to the rest of said anterior body segment. It is contemplated that other alternate embodiments of the door stop may utilize all manner of materials and fasteners to allow for the desired movement of the anterior body segment. By way of one example, a coil spring mounted onto or within the anterior body segment could be utilized in alternate embodiments to allow said body segment to be moved downward, and when said body segment is released, allow the body segment to return to its previous upright position.

Figure 10A:
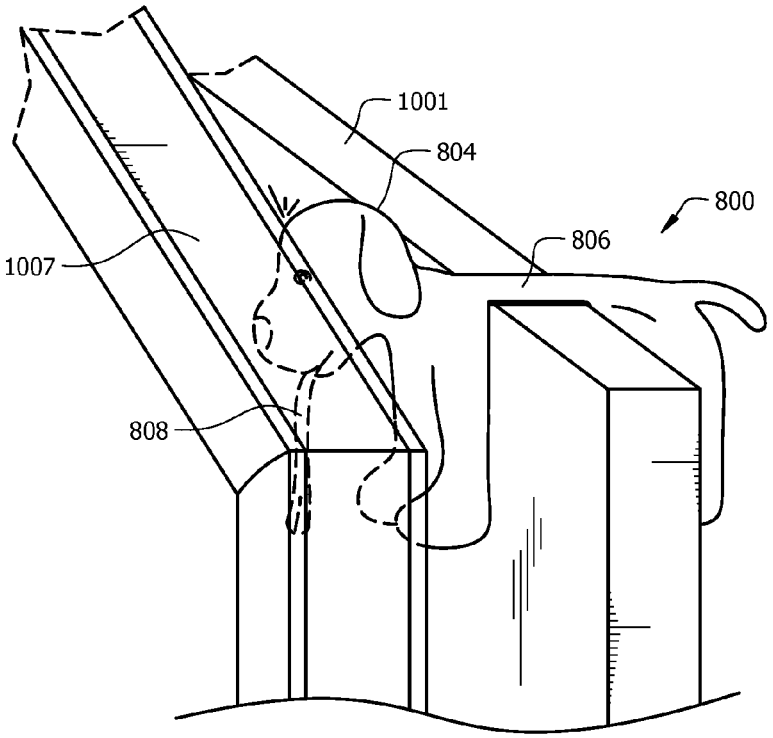
FIG. 10A shows a perspective view of the embodiment of the door stop invention shown in FIG. 9, mounted on a top surface of a door, the anterior body segment of said door stop colliding with an adjacent door frame to prevent closure of the door.
Figure 10B:
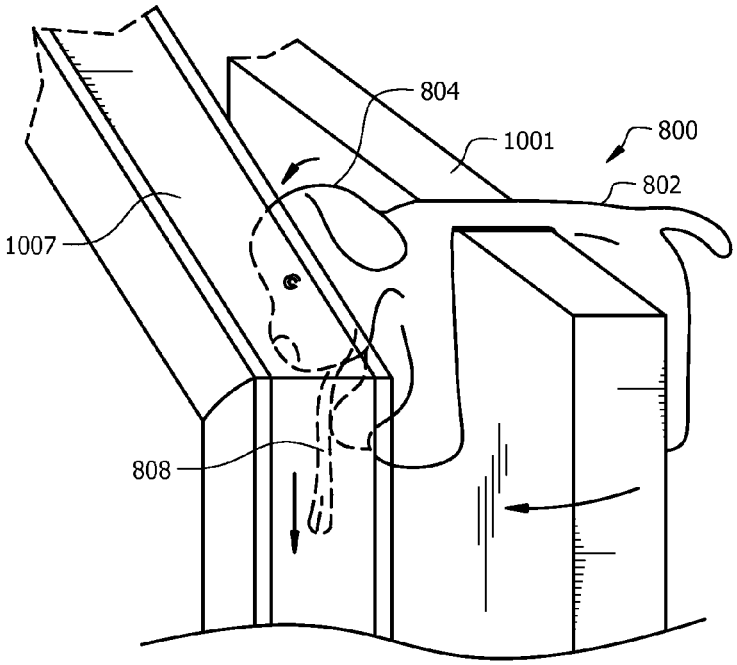
FIG. 10B shows a perspective view of the embodiment of the door stop invention shown in FIG. 10A, mounted on a top surface of a door, the anterior body segment of said door stop extending downward such that said anterior body segment no longer acts as an obstruction (with respect to door frame) that would prevent closure of the door.
Figure 10C:
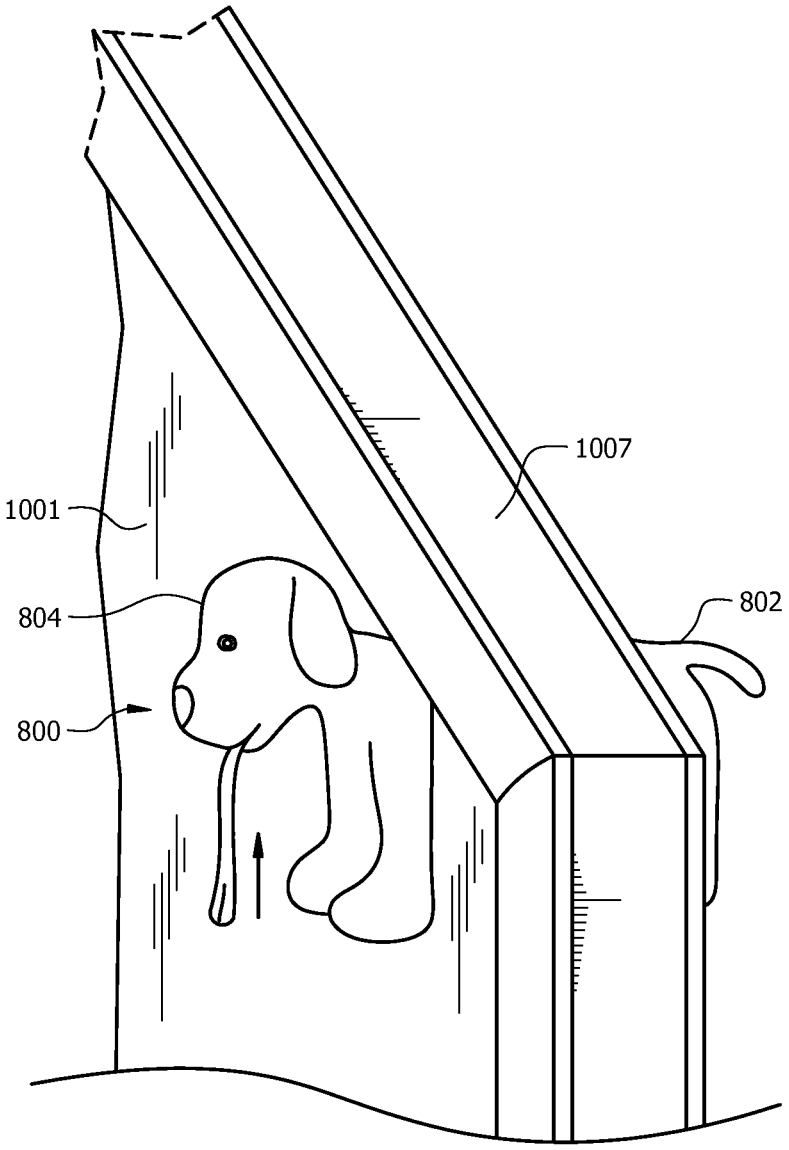
FIG. 10C shows a perspective view of the embodiment of the door stop invention shown in FIG. 10A and FIG. 10B, mounted on a top surface of a door that is fully closed, the anterior body segment of said door stop returning to an upright position.

Referring now to FIGS. 10A, 10B, and 10C, perspective views of the alternate embodiment of the door stop shown at FIGS. 8 and 9, said alternate embodiment mounted upon the top surface of a door (1001). In a first mode of operation, the anterior body segment (804) is in a raised position such that the top portion of said body segment (804) extends above the top of the door (1001). In the first mode of operation, shown at FIG. 10A, the anterior body segment (804) of the door stop prevents the full closure of the door as said body segment (804) collides with the underside of the adjacent door frame (1007) when an attempt is made to fully close the door. Thus, the door stop in this first mode prevents the door from fully closing.

In a second mode of operation, shown at FIG. 10B, a user (not shown) may grasp the elongated handle structure (808), pull downward, thereby causing the anterior body segment to extend or flex downward, thereby removing the obstruction (anterior body segment) that had previously prevented closure of the door. Referring to FIG. 10C, following closure of the door (1001), the anterior body segment returns to its previous upright position. As discussed above, the door stop may utilize the properties of various materials (fabric, cotton, spring(s), hinges, wire, elastic cords, etc.) in conjunction with said door stop to enable the flexible nature of the anterior body segment.

Figure 11:
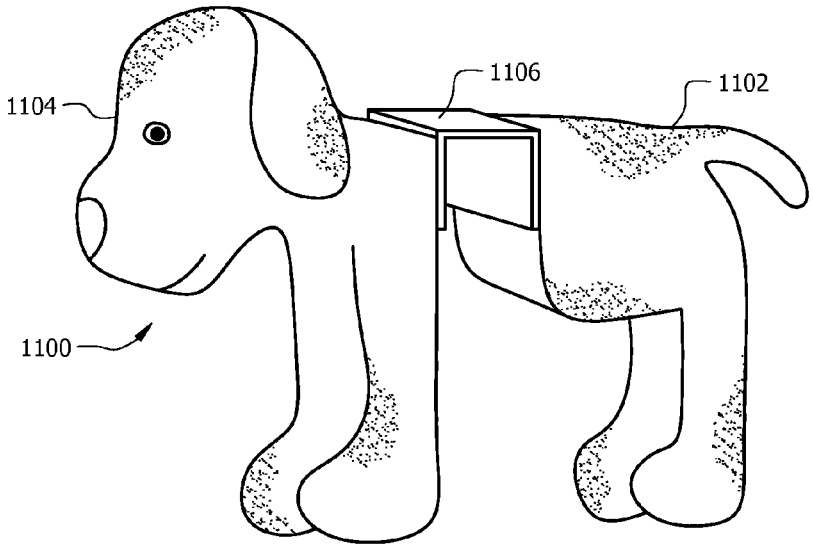
FIG. 11 shows a perspective view of a fifth alternate embodiment of the door stop invention, said alternate embodiment having an anterior body segment joined to a posterior body segment by a connecting member constructed of a substantially rigid material.
Figure 12:
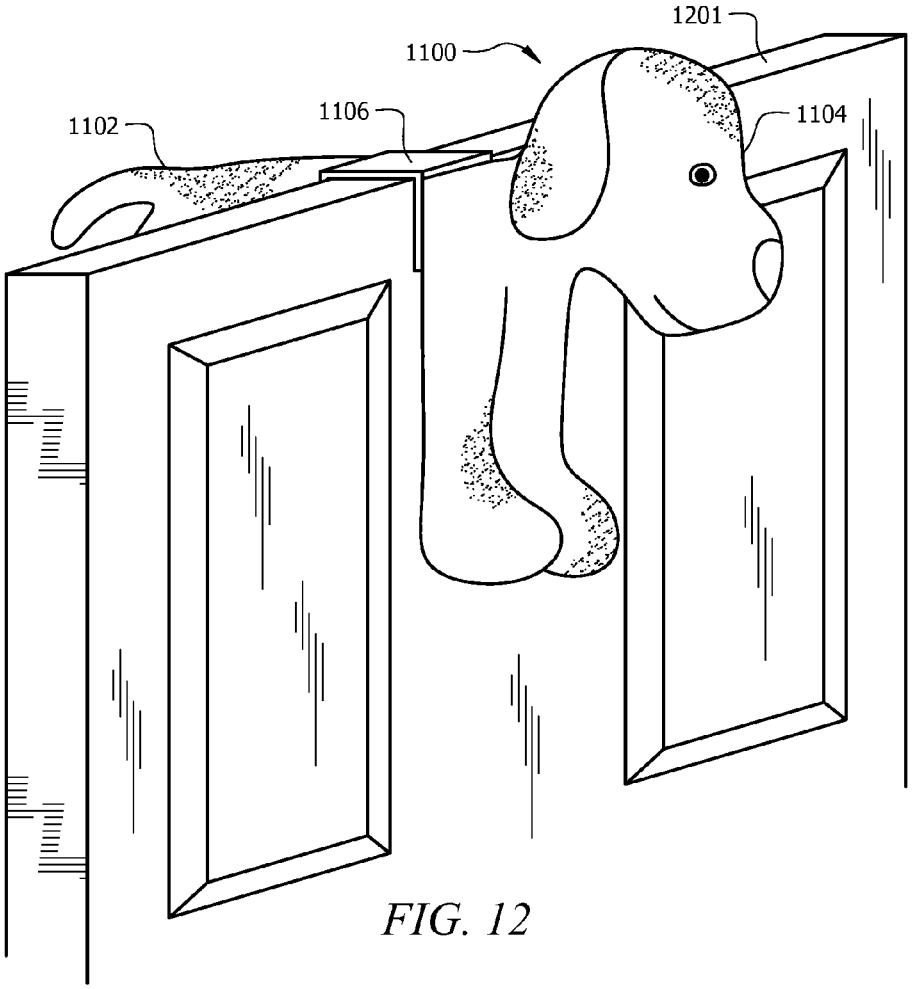
FIG. 12 shows a perspective view of the alternate embodiment of the door stop invention shown at FIG. 11 mounted upon the top surface of a door.

Referring now to FIG. 11 and FIG. 12, perspective views of an even further alternate embodiment (1100) of the door stop invention. The door stop (1100) includes an anterior body segment (1104) that is joined to a posterior body segment (1102) by a connecting member (1106) constructed of a substantially rigid material. In the alternate embodiment shown at FIG. 11 and FIG. 12, the rigid connecting member is constructed of a rigid plastic material that is formed to have a rectangular shaped channel shaped to mate with the top surface of a door as shown in FIG. 12.

Those of ordinary skill in the art will appreciate that in alternate embodiments of the door stop, certain materials having adhesive-like properties may be used in conjunction with the connecting member to keep the door stop secured to a door surface. For example, an adhesive or a material having at least one surface having adhesive like qualities (when in contact with door surface) may be applied to the underside of the connecting member to keep the door stop secured to a surface of a door. In another example, the connecting member could at least partially be constructed of a magnet such that when the door stop is mounted to a metal door, the magnet will assist in securing the door stop to the door, while at the same time allowing the door stop to be easily removed by a user. In an even further example of an alternate embodiment, a velcro type strip may be attached to the underside of the connecting member, and a corresponding velcro strip attached to the surface of a door, to allow for removable securing of the door stop to a door.

It should be noted that the description of the present invention has been presented for purposes of illustration and description, and is not intended to be exhaustive or limited to the invention in the form disclosed. Many modifications and variations will be apparent to those of ordinary skill in the art. The preferred embodiment appearing in the drawings was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims.

I claim:

1. A door stop comprising:

a first body segment;

a second body segment; and a connecting member having a first end attached to said first body segment, said connecting member having a second end connected to said second body segment;

wherein said first body segment may be extended in relation to said second body segment;

wherein in a first mode of operation of said door stop, when said connecting member is mounted on a surface of a door such that said first body segment is oriented proximal to an adjacent door frame and said second body segment is oriented distal to said adjacent door frame, at least a portion of said first body segment protrudes beyond said surface of said door so as to inhibit said door from fully closing with respect to said adjacent door frame;

wherein in a second mode of operation of said door stop, when said connecting member is mounted on a surface of said door such that said second body segment is oriented proximal to said adjacent door frame and said first body segment is oriented distal to said adjacent door frame, said second body segment does not inhibit said door from fully closing with respect to said door frame;

wherein in a third mode of operation of said door stop, when said connecting member is mounted on said surface of said door, said first body segment is capable of being extended in relation to said second body segment such that no portion of said first body segment protrudes beyond said surface of said door so as to inhibit said door from fully closing with respect to said door frame.

2. The door stop of claim 1, wherein said connecting member is constructed of an elastic material.

3. The door stop of claim 2, wherein said connecting member comprises one or more elastic cords.

4. The door stop of claim 1, further comprising a handle attached to a forward end of said first body segment, wherein said handle may be used to apply a downward force to extend said first body segment.

5. The door stop of claim 4, wherein by extending said first body segment in relation to said second body segment, at least a portion of said first body segment rotates in a downward direction.

6. The door stop of claim 3, wherein a fastener is attached to said second end of each of said one or more elastic cords, wherein said fastener prevents movement of said second body segment beyond a predetermined distance from said first body segment.

7. The door stop of claim 4, wherein said first body segment and said second body segment are shaped to resemble an animal.

8. The door stop of claim 7, wherein said handle is elongate in shape.

9. The door stop of claim 1, wherein said surface of said door is a top surface of said door.

10. The door stop of claim 1, wherein said surface of said door is a side surface of said door most proximal to an adjacent door frame when said door is fully closed.

* * * * *